United States Patent [19]

Yokoi et al.

[11] Patent Number: 4,723,529

[45] Date of Patent: Feb. 9, 1988

[54] OIL SEPARATOR FOR A BLOWBY GAS VENTILATION SYSTEM OF AN INTERNAL COMBUSTION ENGINE

[75] Inventors: Tatsuhisa Yokoi; Yasuji Nishi, both of Toyota; Eisaku Takeya, Aichi, all of Japan

[73] Assignee: Toyota Jidosha Kabushiki Kaisha, Toyota, Japan

[21] Appl. No.: 884,058

[22] Filed: Jul. 10, 1986

[30] Foreign Application Priority Data

Jul. 19, 1985 [JP] Japan ..... 60-109632[U]

[51] Int. Cl.[4] ..... F02B 25/06; F01M 13/04

[52] U.S. Cl. ..... 123/573; 123/41.86

[58] Field of Search ..... 123/572, 573, 574, 587, 123/41.86, 90.37, 90.38; 184/6.23

[56] References Cited

U.S. PATENT DOCUMENTS

| | | | |
|---|---|---|---|
| 2,974,652 | 3/1961 | Benzinger | 123/41.86 |
| 4,565,164 | 1/1986 | Satoh | 123/41.86 |
| 4,602,595 | 7/1986 | Aoki | 123/90.38 |
| 4,627,406 | 12/1986 | Namiki | 123/573 |

FOREIGN PATENT DOCUMENTS

| | | |
|---|---|---|
| 51-107542 | 2/1975 | Japan . |
| 5781415 | 11/1980 | Japan . |
| 59-163113 | 11/1984 | Japan . |

*Primary Examiner*—Craig R. Feinberg
*Assistant Examiner*—M. Macy
*Attorney, Agent, or Firm*—Oblon, Fisher, Spivak, McClelland & Maier

[57] ABSTRACT

An oil sparator for a blowby gas ventilation system of an internal combustion engine which includes a cylinder head cover, a baffle plate, a blowby gas path formed between the cylinder head cover and the baffle plate, and a filter provided in the blowby gas path. A groove is formed in the baffle plate and extends along the filter over the entire width of a top wall of the baffle plate. The filtered oil collects in the groove and does not appear on the upper surface of the top wall of the baffle plate. Therefore, the collected oil in the groove does not flow through the filter together with the blowby gas. As a result, oil consumption is decreased and oil blow-out through a blowby gas outlet is prevented.

13 Claims, 6 Drawing Figures

OIL SEPARATOR FOR A BLOWBY GAS VENTILATION SYSTEM OF AN INTERNAL COMBUSTION ENGINE

BACKGROUND OF THE INVENTION

1. Field of the Invention:

The present invention relates to an oil separator for a blowby gas ventilation system of an internal combustion engine and specifically relates to an oil separator for reducing the amount of oil ventilated to an intake path of the internal combustion engine.

2. Description of the Prior Art:

An oil separator is provided in the blowby gas ventilation system of an internal combustion engine for the purpose of separating oil from the blowby gas and reducing an amount of oil which is ventilated to the intake path of the internal combustion engine and burnt in the combustion chamber of the engine. The oil separator is provided above the camshaft in the cylinder head cover, in which oil drops splashed by the rotating camshaft and oil mist are filled, and separates oil from the blowby gas. The conventional oil separator is constructed of a baffle plate giving the blowby gas path a plurality of enlarged cross-sections and throttled cross-sections for the purpose of causing velocity differences between the oil and the blowby gas due to the inertia differences thereof, thereby increasing the degree of oil separation. However, such an oil separator is insufficient in separating oil from the blowby gas because fine oil drops and oil mist included in the blowby gas have nearly the same velocity as the blowby gas and can easily pass through the oil separator together with the blowby gas.

To increase the oil separating ability of the oil separator, it is presumed possible to install an oil filter in the blowby gas path and to let the blowby gas flowing to the intake path of the internal combustion engine flow through the filter. When the blowby gas path is formed between the top wall of the cylinder head cover and the baffle plate housed in the cylinder head cover, the oil filter should extend from the top wall of the cylinder head cover to the baffle plate in the vertical direction to let the entire amount of the blowby gas flowing to the intake path of the engine flow through the filter.

However, if the filter is provided in the above-mentioned manner, the oil which is separated from the blowby gas by the oil filter will flow downward in the oil filter and/or along the upstream side surface of the oil filter and will collect on the upper surface of the baffle plate in the vicinity of the oil filter. The collecting oil is blown due to the flow of the blowby gas and easily passes through the oil filter, resulting in decreasing the filtering ability of the oil filter and increasing oil consumption.

SUMMARY OF THE INVENTION

An object of the present invention is to provide, in an oil separator for a blowby gas ventilation system of an internal combustion engine having an oil filter between the cylinder head cover and the baffle plate housed in the cylinder head cover, a structure for preventing the oil which is filtered by the oil filter and which has collected on the baffle plate from flowing through the oil filter.

The above object of the present invention is achieved by an oil separator for a blowby gas ventilation system of an internal combustion engine which comprises a cylinder head cover, a baffle plate housed in the cylinder head cover, a blowby gas path formed between the cylinder head cover and the baffle plate, and a blowby gas inlet formed of a space formed between the cylinder head cover and the baffle plate and a blowby gas outlet provided at the cylinder head cover, a filter provided in the blowby gas path formed between the blowby gas inlet and the blowby gas outlet and extending from the cylinder head cover to the baffle plate in the vertical direction, and a groove formed in the baffle plate below the filter and extending over the entire width of the baffle plate along the oil filter in the width direction of the baffle plate.

In the oil separator thus constructed, the oil filtered by the oil filter and separated from the blowby gas flows downward in the oil filter and/or along the upstream surface of the oil filter and collects in the groove formed in the baffle plate. Then the collected oil in the groove flows toward both longitudinal ends of the groove and drops downward from the groove to the upper surface of the cylinder head through the space formed between the baffle plate and the cylinder head cover. Since the groove is concave with respect to the blowby gas path and the oil collecting in the groove does not appear on the upper surface of the baffle plate, the oil will not be blown by the blowby gas and will not flow through the oil filter. Therefore, oil consumption will be conspicuously decreased.

BRIEF DESCRIPTION OF THE DRAWINGS

The above and other objects of the present invention will become apparent and more readily appreciated from the following detailed description of preferred exemplary embodiments of the present invention, taken in conjunction with the accompanying drawings, in which.

DESCRIPTION OF THE PREFERRED EMBODIMENT

Figure 1:
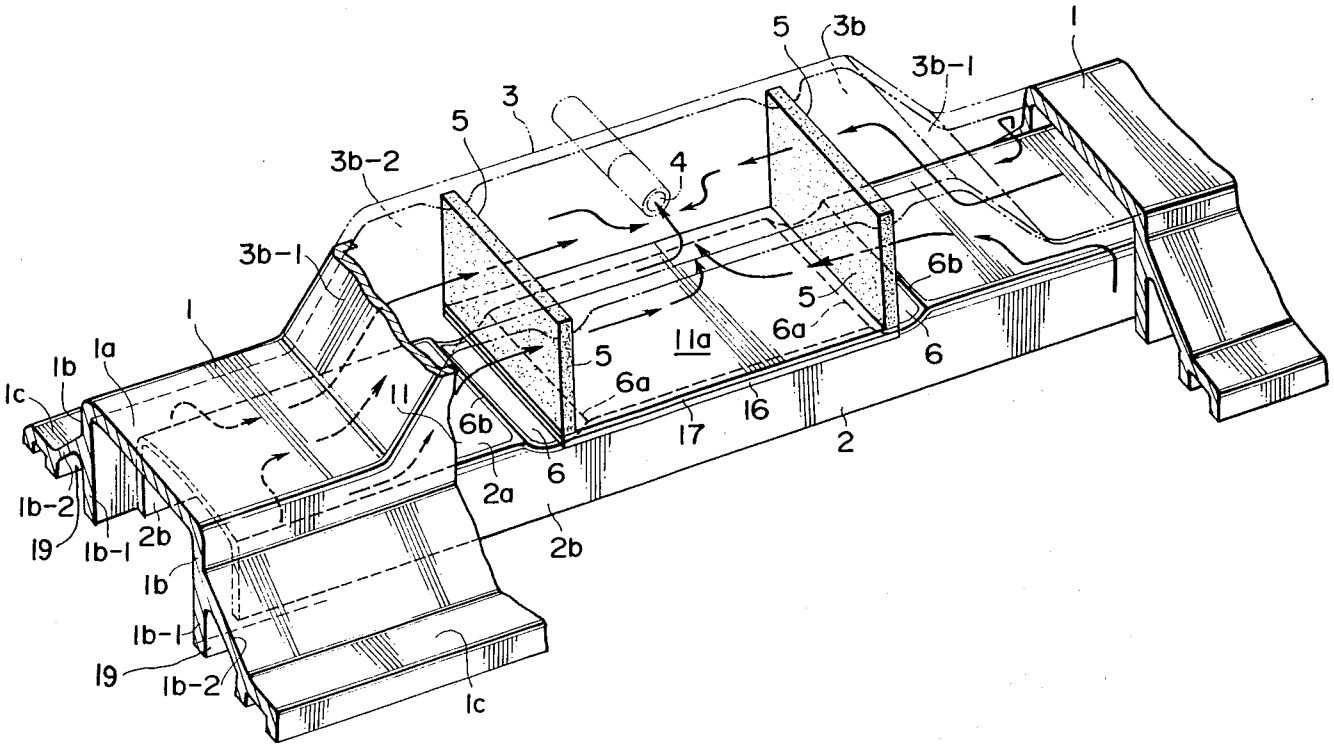
FIG. 1 is an oblique view of an oil separator for a blowby gas ventilation system of an internal combustion engine in accordance with one embodiment of the present invention.
Figure 2:
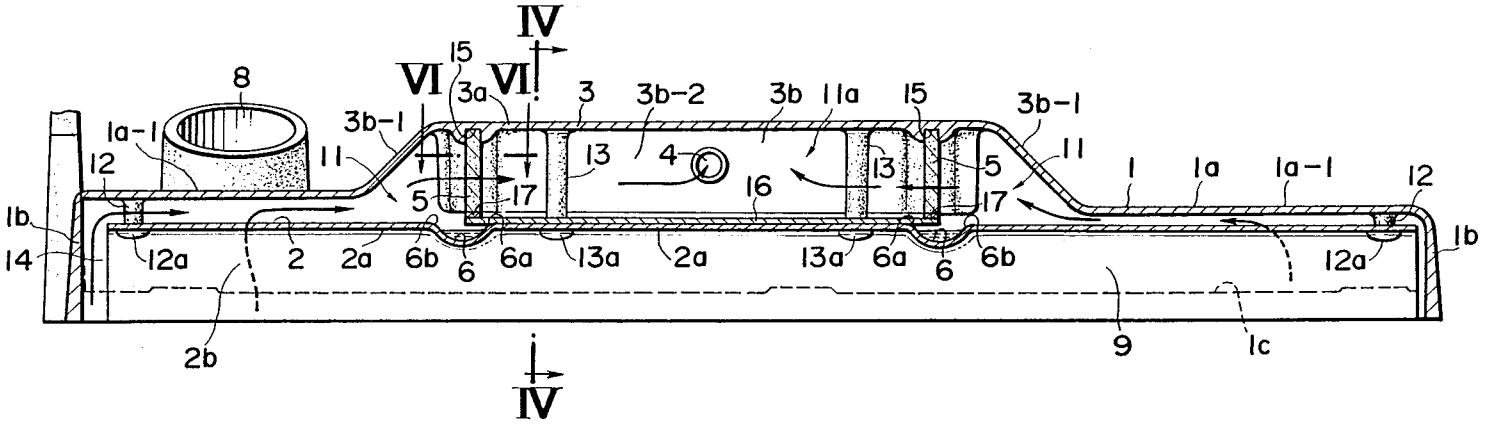
FIG. 2 is a sectional view of the oil separator of FIG. 1.
Figure 3:
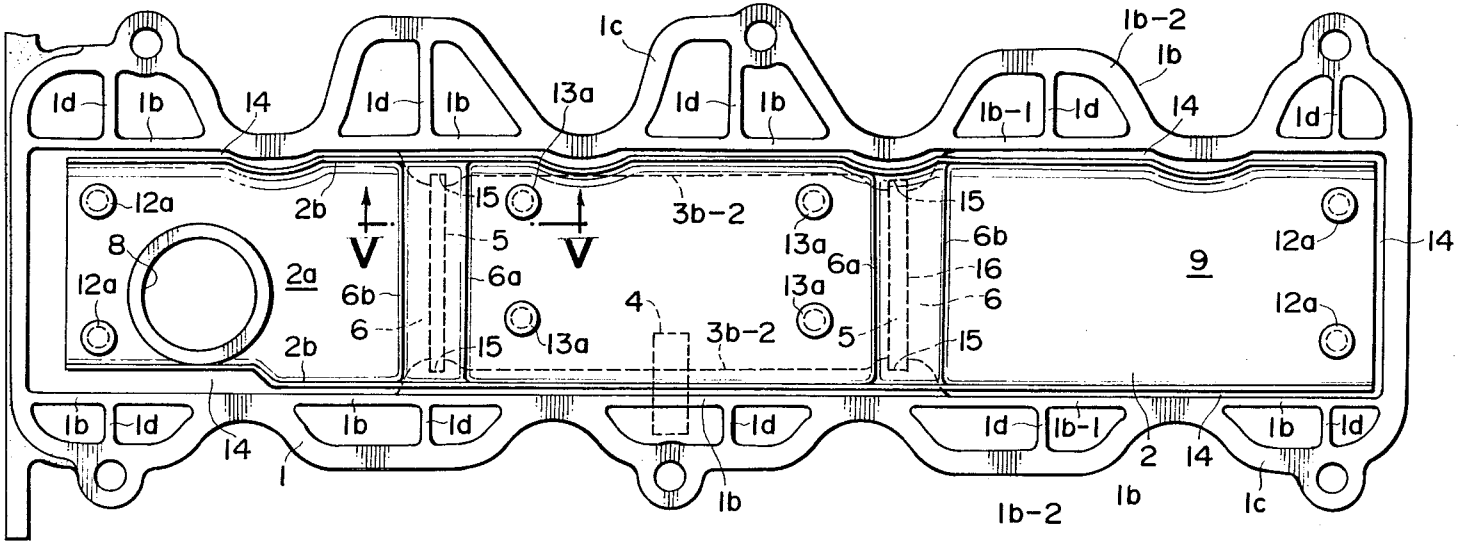
FIG. 3 is a bottom view of the oil separator of FIG. 2.
Figure 4:
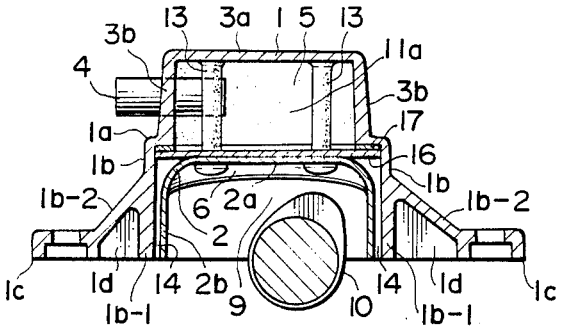
FIG. 4 is a sectional view taken along line IV—IV in FIG. 2.
Figure 5:
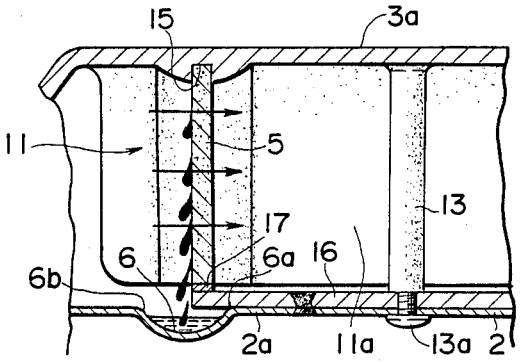
FIG. 5 is a sectional view taken along line V—V in FIG. 2.
Figure 6:
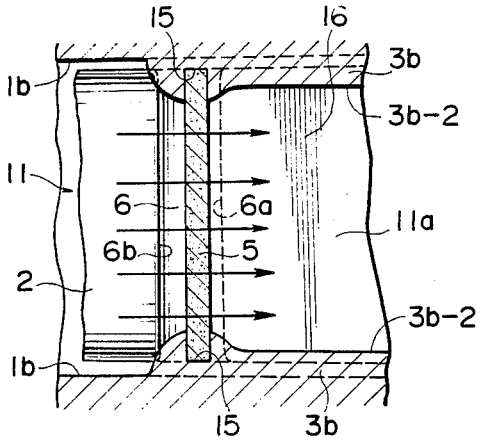
FIG. 6 is a sectional view taken along line VI—VI in FIG. 2.

FIGS. 1 to 6 show an oil separator for a blowby gas ventilation system of an internal combustion engine in accordance with one embodiment of the present invention.

A cylinder head is covered by a cylinder head cover 1 which is fixed to the cylinder head. The space in the cylinder head cover is a camshaft housing room 9 in which a camshaft 10 is rotatably housed. In the cylinder head cover 1, a baffle plate 2 is provided above the camshaft 10.

The cylinder head cover 1 has a horizontally extending top wall 1*a* and a side wall 1*b* which extends downward from the periphery of the top wall 1*a*. The side wall 1*b* of the cylinder head cover 1 is integrally connected to a horizontally extending flange 1c at which the cylinder head cover 1 is fixed to the cylinder head by bolts. The flange 1c has a plan shape corresponding to the plan shape of the upper portion of the cylinder head. The side wall 1b of the cylinder head cover 1 comprises an inside wall 1b-1 and an outside wall 1b-2 which diverges from the inside wall 1b-1 and extends obliquely downward to the flange 1c. Below the space 19 surrounded by the inside wall 1b-1 and the outside wall 1b-2 a plurality of oil return holes and blowby gas flow holes (not shown) are formed in the cylinder head and a cylinder block. The inside wall 1b-1 and the outside wall 1b-2 are reinforced by ribs 1d which extend in the transverse direction. In the vicinity of the end portion of the top wall 1a of the cylinder head cover an oil pour hole 8 is formed and the oil pour hole 8 is closed by a cap (not shown).

The cylinder head cover 1 extends along the longitudinal direction of the internal combustion engine. The longitudinal middle portion of the top wall 1a of the cylinder head cover 1 is raised upward and constitutes a raised portion 3. The raised portion 3 constitutes one portion of the top wall 1a of the cylinder head cover 1. The raised portion 3 has a horizontally extending raised portion top wall 3a and a raised portion side wall 3b which extends downward from the periphery of the raised portion top wall 3a. The raised portion side wall 3b comprises opposing front and rear portions 3b-1 which are located at the longitudinal ends of the raised portion top wall 3a and extend obliquely downward from the longitudinal ends of the raised portion top wall 3a to a non-raised portion 1a -1 of the top wall 1a of the cylinder head cover 1 and opposing side portions 3b-2 which are located at both width ends of the raised portion top wall 3a and extend downward from both width ends of the raised portion top wall 3a to the side wall 1b of the cylinder head cover 1.

The baffle plate 2 has a top wall 2a and a pair of side walls 2b which extend downward from the width ends of the top wall 2a. The top wall 2a of the baffle plate 2 is slightly curved in the width direction so that the middle width portion of the top wall 2a of the baffle plate 2 is higher than the width end portions of the top wall 2a of the baffle plate 2. The baffle plate 2 extends in the longitudinal direction from an area in the vicinity of one longitudinal end of the cylinder head cover 1 to another area in the vicinity of the other longitudinal end of the cylinder head cover 1. Between each of the side walls 2b of the baffle plate 2 and the inside wall 1b-1 of the side wall 1b of the cylinder head cover 1 is formed a space for letting the oil collecting on the top wall 2a of the baffle plate 2 drop down to the upper surface of the cylinder head.

The top wall 2a of the baffle plate 2 is located below the top wall 1a of the cylinder head cover 1 including the raised portion 3. The space formed between the top wall 2a of the baffle plate 2 and the top wall 1a of the cylinder head cover 1 including the raised portion 3 constitutes a blowby gas path 11 for the ventilation system through which the blowby gas flows to an intake path of the internal combustion engine. To keep a space for the blowby gas path 11, projections 12 and pillars 13 which protrude downward are formed in the top wall 1a of the cylinder head cover 1 and the baffle plate 2 is fixed to the cylinder head cover 1 by means of the projections 12 and the pillars 13. The projections 12 are formed in the top wall 1a1 of the non-raised portion and the pillars 13 are formed in the raised portion top wall 3a. The projections 12 and the pillars 13 penetrate the top wall 2a of the baffle plate 2 and the lowermost portions of the projections 12 and the pillars 13 are caulked. Reference numerals 12a and 13a show the caulked portions. Since the projections 12 and pillars 13 are constructed of the same material as that of the cylinder head cover 1, that is, aluminum, they can be easily caulked. The blowby gas flows into the blowby gas path 11 through blowby gas inlets 14 which comprises the spaces formed between the side walls 2b and the longitudinal ends of the top wall 2a of the baffle plate 2 and the side wall 1b of the cylinder head cover 1. A blowby gas outlet 4 is provided at the longitudinal middle portion of the raised portion side wall 3b-2. The blowby gas outlet is constructed of a pipe which penetrates the raised portion side wall 3b-2 and protrudes into the blowby gas path 11 to prevent the oil attached on the inside surface of raised portion 3 from easily flowing into the pipe. The blowby gas which has flown into the blowby gas path 11 flows out through the blowby gas outlet 4 toward the intake path of the internal combustion engine.

In the blowby gas path 11, a filter 5 is provided. The filter 5 is provided between the blowby gas inlet 14 and the blowby gas outlet 4. The filter 5 is provided at each upstream side of the blowby gas outlet 4, and therefore, two filters 5 are provided. The filter 5 consists of a plate-like filter member. The filter 5 consists of a material which can allow the blowby gas to flow therethrough and can separate oil from the blowby gas, such as a foam metal. Such a foam metal filter 5 can be produced by plating metal on a sponge-like material and then burning out the sponge-like material. The filter 5 extends from the top wall 1a of the cylinder head cover 1 to the top wall 2a of the baffle plate 2 in the vertical direction, and more particularly the filter 5 extends from the raised portion top wall 3a to the top wall 2a of the baffle plate 2 in the vertical direction. The filter 5 extends between the opposed side portions 3b-2 and 3b-2 of the raised portion side wall 3b in the horizontal direction. The cylinder head cover 1 has a seal groove 15 on the inside surface thereof. The upper end and the side ends of the filter 5 are seal-engaged with the seal groove 15. Between the bottom portions of the two filters 5 a seal plate 16 extends. The seal plate 16 is fixed to the top wall 2a of the baffle plate 2 by welding. A seal gasket 17 is interposed between the upper surface of the seal plate 16 and the bottom ends of the filters 5 and the raised portion 3. The gasket 17 and the seal plate 16 seal the portion 11a of the blowby gas path 11 which is located between the two filters 5 from the other space inside of the cylinder head cover 1 and the blowby gas can flow into the portion 11a of the blowby gas path 11 only through the filters 5. Since the filter 5 extends over the entire transverse section of the blowby gas path 10, the entire amount of the blowby gas which flows from the blowby gas inlet 14 toward the blowby gas outlet 4 flows through the filter 5.

A groove 6 is formed in the top wall 2a of the baffle plate 2. The groove 6 is concave to the blowby gas path 11 and opens upward to the blowby gas path 11. The groove 6 can be formed by press forming of the baffle plate 2. The groove 6 is located below the filter 5 and extends along the lower portion of the filter 5 in the width direction of the baffle plate 2. The groove 5 extends over the entire width of the top wall 2a of the baffle plate 2 and, at both longitudinal ends of the groove 6, opens to the spaces 14 between the side walls 2b of the baffle plate 2 and the inside wall 1b-1 of the side wall 1b of the cylinder head cover 1.

One width edge 6a of the groove 6 is located just below the longitudinal end portion of the seal plate 16 and the other width edge 6b of the groove 6 is located upstream of the filter 5. The groove 6 opens to the blowby gas path 11 partially in the width direction of the groove 6. The seal plate 16 seals the portion 11a of the blowby gas path 11 from the groove 6.

The groove 6 has an elongated semicircular transverse cross-section. The groove may have a semicircular transverse cross-section and further may have a rectangular transverse section. The groove 6 is of such a depth that the oil which has collected in the groove 6 does not overflow the groove 6 and can flow down from the both longitudinal ends of the groove 6 to the floor of the camshaft housing room 9. The groove 6 has a bottom which extends gradually downward in the longitudinal direction of the groove 6 in accordance with the curvature of the top wall 2a of the baffle plate 2 so that the oil collecting in the groove 6 can flow toward both longitudinal ends of the groove 6. The grooves 6 are provided in the baffle plate 2 for both filters 5 which are provided both upstream sides of the blowby gas outlet 4.

Next, operation of the oil separator of the present invention will be explained.

Oil drops and oil mist splashed by the rotating camshaft 10 strike the baffle plate 2 and are primarily separated from the blowby gas by the baffle plate 2. The blowby gas including oil drops and oil mist which have not been separated from the blowby gas by the baffle plate 2 flows from the camshaft housing room 9 in the cylinder head cover 1 into the blowby gas path 11 formed between the baffle plate 2 and the cylinder head cover 1 through the blowby gas inlet 14. The blowby gas comes to the filter 5 and oil included in the blowby gas is filtered by the filter 5 and is separated from the blowby gas when passing through the filter 5. Since the filter 5, the seal plate 16 and the gasket 17 separates the portion 11a of the blowby gas path 11 which is located downstream of the filter 5 from the other space in the cylinder head cover 1, the entire amount of the blowby gas which flows toward the blowby gas outlet 4 flows through the filter 5. The blowby gas which has passed through the filter 5 flows out through the blowby gas outlet 4.

Oil which is filtered by the filter 5 flows down in the filter 5 and/or along the upstream surface of the filter 5 and collects in the groove 6. Therefore, the oil collecting in the groove 6 does not appear on the upper surface of the baffle plate 2. The oil collecting in the groove 6 flows toward the longitudinal ends of the groove 6 and flows down from both longitudinal ends of the groove 6 toward the floor of the camshaft housing room 9 along the outside surface of each side wall 2b of the baffle plate 2 through the spaces 14 formed between each side wall 2b of the baffle plate 2 and the inside wall 1b-1 of the side wall 1b of the cylinder head cover 1. The oil which has dropped to the upper surface of the cylinder head flows through the oil return holes formed in the cylinder head and the cylinder block to the oil pan which is fixed to the bottom of the cylinder block together with the remaining oil which has been used for lubrication of a contact portion between a cam and a valve.

If the groove 6 was not provided in the baffle plate 2, a part of the filtered oil would collect on the upper surface of the top wall 2a of the baffle plate 2 and the oil which collected upstream of the filter 5 would flow through the filter 5 due to the flow of the blowby gas. However, since the filtered oil collects in the groove 6 in the present invention and does not receive the direct force of the flow of the blowby gas, the filtered oil does not flow through the filter 5. Therefore, the oil filtering function of the filter 5 is not limited and oil consumption is decreased.

Owing to the oil separator of the present invention, various effects such as a sufficient oil separation by the filter 5, a decrease in oil consumption and prevention of blow-out of oil through the blowby gas outlet 4 can be obtained.

Although only one embodiment of the present invention has been described in detail, it will be appreciated by those skilled in the art that various modifications and alterations can be made to the particular embodiment shown without materially departing from the novel teachings and advantages of the present invention. Accordingly, it is to be understood that all such modifications and alterations are included within the scope of the invention as defined by the following claims.

What is claimed is:

1. An oil separator for a blowby gas ventilation system of an internal combustion engine, comprising:
   - a cylinder head cover;
   - a baffle plate housed in said cylinder head cover;
   - blowby gas path means formed between said cylinder head cover and said baffle plate;
   - a blowby gas inlet formed by a space formed between said cylinder head cover and said baffle plate and a blowby gas outlet provided at said cylinder head cover; and
   - a filter provided in said blowby gas path means between said blowby gas inlet and said blowby gas outlet, said filter extending from said cylinder head cover to said baffle plate in a vertical direction wherein a groove is formed in said baffle plate, said groove being located below said filter and extending along said filter over an entire width portion of said baffle plate wherein said baffle plate comprises side walls extending downward from the width ends of said top wall of said baffle plate, a space is formed between each of said side walls of said baffle plate and a side wall of said cylinder head cover, and wherein length ends of said groove open to each said space formed between said side walls of said baffle plate and said side wall of said cylinder head cover.

2. The oil separator for a blowby gas ventilation system of an internal combustion engine of claim 1, wherein said groove is concave in shape with respect to said blowby gas path means.

3. The oil separator for a blowby gas ventilation system of an internal combustion engine of claim 1, wherein said groove comprises a press formed groove.

4. The oil separator for a blowby gas ventilation system of an internal combustion engine of claim 1, wherein said filter comprises a plate-like filter member.

5. The oil separator for a blowby gas ventilation system of an internal combustion engine of claim 1, wherein said filter comprises a foam metal filter member.

6. The oil separator for a blowby gas ventilation system of an internal combustion engine of claim 1, wherein a top wall of said baffle plate is curved such that a width middle portion of said top wall of said baffle plate is higher than width end portions of said top wall of said baffle plate.

7. An oil separator for a blowby gas ventilation system of an internal combination engine, comprising:

a cylinder head cover having a top wall and a side wall extending downward from a peripheral portion of said top wall, top wall of said cylinder head cover including a raised portion raised upward from a non-raised portion of said top wall of said cylinder head cover, said raised portion having a raised portion top wall and a raised portion side wall extending from a peripheral portion of said raised portion top wall to said non-raised portion of said top wall of said cylinder head cover;

a baffle plate housed in said cylinder head cover, said baffle plate having a top wall and a side wall extending downward from each width end portions of said top wall of said baffle plate;

blowby gas path means formed between said top wall of said cylinder head cover and said top wall of said baffle plate;

a blowby gas inlet formed by a spaced formed between said cylinder head cover and said baffle plate and a blowby gas outlet provided at said raised; and a first filter provided in said blowby gas path means between said blowby gas inlet and said blowby gas outlet, said filter extending from said raised portion top wall to said top wall of said baffle plate in a vertical direction and extending between opposed side portions of said raised portion side wall in a horizontal direction wherein a group, concave to said blowby gas path, is formed in said top wall of said baffle plate, said groove being located between said filter and extending along said filter over an entire width portion of said baffle plate, said baffle plate comprises side walls extending downward from the width ends of said top wall of said baffle plate, a space is formed between each of said side walls of said baffle plate and a side wall of said cylinder head cover, and wherein length ends of said groove open to each said space formed between said side walls of said baffle plate and said side wall of said cylinder head cover.

8. The oil separator for a blowby gas ventilation system of an internal combustion engine of claim 7, wherein said raised portion top wall and said raised portion side wall have a seal groove, and wherein the upper end and the side ends of said filter are seal-engaged with said seal groove.

9. The oil separator for a blowby gas ventilation system of an internal combustion engine of claim 7, wherein said cylinder head cover further comprises a projection and a pillar which protrude downward and means for fixing said baffle plate to said cylinder head cover at end portions of said projection and pillar.

10. The oil separator for a blowby gas ventilation system of an internal combuation engine of claim 9, said filter having two filter elements, each element being located upstream of said blowby gas outlet, and further comprising a seal plate extending to bottom ends of said filter elements.

11. The oil separator for a blowby gas ventilation system of an internal combustion engine of claim 10, futher comprising a gasket interposed between the upper surface of said seal plate and bottom end portions of said filters and said raised portion, wherein said gasket and said seal plate seal a portion of said blowby gas path means downstream of said filters from a remaining space inside said cylinder head cover.

12. The oil separator for a blowby gas ventilation system of an internal combustion engine of claim 10, wherein a first width edge of said groove is located below said seal plate and a second width edge of said groove is located upstream of said filter.

13. The oil separator for a blowby gas ventilation system of an internal combustion engine of claim 10, further comprising means for fixing said seal plate to said baffle plate.

* * * * *